United States Patent [19]

Kertzscher

[11] Patent Number: 4,811,638

[45] Date of Patent: Mar. 14, 1989

[54] TORQUE TOOLS

[76] Inventor: Ernst Kertzscher, 21350 Olinda Trail North, Scandia, Minn. 55073

[21] Appl. No.: 185,887

[22] Filed: Apr. 25, 1988

[51] Int. Cl.[4] ..... B25B 23/16

[52] U.S. Cl. ..... 81/177.2; 81/125.1

[58] Field of Search ..... 81/119, 121.3, 121.4, 81/125.1, 177.2

[56] References Cited

U.S. PATENT DOCUMENTS

| | | | |
|---|---|---|---|
| 905,650 | 12/1908 | Clarke et al. . | |
| 916,613 | 3/1909 | Scruggs . | |
| 1,371,533 | 3/1921 | Wright . | |
| 1,463,077 | 7/1923 | Gandell . | |
| 1,643,027 | 9/1927 | Morgan . | |
| 1,741,810 | 12/1929 | Bioal | 81/177.2 |
| 1,746,452 | 2/1930 | Wesson . | |
| 2,142,589 | 1/1939 | Olson . | |
| 2,490,739 | 12/1949 | Nesbitt . | |
| 3,376,768 | 4/1968 | Fortunato . | |
| 3,839,929 | 10/1974 | Richards . | |
| 3,996,821 | 12/1976 | Murray | 81/177.2 |
| 4,104,935 | 8/1978 | Stoops . | |
| 4,212,336 | 7/1980 | Smith | 81/177.2 X |
| 4,305,438 | 12/1981 | Spinosa et al. | 81/124.3 X |
| 4,596,167 | 6/1986 | White, Jr. . | |

OTHER PUBLICATIONS

Tool Catalog page showing Crowfoot Wrenches.

*Primary Examiner*—James G. Smith

*Attorney, Agent, or Firm*—Jacobson and Johnson

[57] ABSTRACT

A tool for use in tightening or removing a fastener that requires greater torque than the user can generate through application of hand force on the handle of the tool with the handle of the tool having sufficient length for a user to grasp in the user's hand as the user tightens or removes a fastener. The handle of the tool having a head with jaws for engaging a fastener to tighten or remove the fastener and a second end on the opposite end of the handle having a square opening to receive a drive mechanism to permit the user to increase the torque on a fastener by providing a longer lever to thereby permit the user to increase the torque on the fastener without the user having to increase the hand force.

3 Claims, 1 Drawing Sheet

TORQUE TOOLS

FIELD OF THE INVENTION

This invention relates generally to tools and, more specifically, to wrench and handle combination that enable a user to minimize hand pressure when tightening or removing lugs or nuts.

BACKGROUND OF THE INVENTION

The concept of torque multipliers or handles for wrenches is well known in the art. In general some type of device is fitted over the wrench to enable the user to increase the leverage on the wrench. Such extension handles to increase leverage are often referred to as "cheaters". The advent of more complicated machines that have fasteners located in places that are difficult to reach has also required that for certain applications that the extension handle be offset. In addition, a number of mechanics oftentimes do not possess the inherent physical strength to loosen or tighten a fastener to the correct specification. With machines being made more compact, a need has developed for a tool that will enable the user to increase the leverage on the tool without increasing the bulkiness of the tool. In addition, with work time at a premium it is necessary to have a tool that requires as little time as possible to use. The present invention addresses the problems of the prior art by providing wrenches that are compatible for use with socket drive sets.

DESCRIPTION OF THE PRIOR ART

The Prior art is replete with numerous inventions that have been conceived to address the problem of increasing the torque that can be applied to a conventional wrench through use of an extension handle that mounts on the wrench.

The Clarke & Szafka U.S. Pat. No. 905,650 shows one of the earlier special extension handle for wrenches that allows a user to slip the end of the wrench into the special handle. The Clarke & Szafka handle is limited to vertical extension of the handle and requires a spring to hold the handle on the wrench. To increase the leverage on the wrench the user applies the force on the handle.

The Scruggs U.S. Pat. No. 916,613 shows a similar extension handle with an opening to slip over the end of the wrench to increase the leverage on the wrench. The Scruggs handle is limited to use with those wrenches that have a head on only one end. Scruggs extension handle only permits extension in the direction along the handle of the wrench.

The Wright U.S. Pat. No. 1,371,533 shows a special tool handle that has an opening therein to fit over the jaw of a fixed jaw wrench to enable the user to increase the leverage on the wrench. The Wright handle is limited to use with double open ended jaws at each end of th wrench and also only increases the leverage arm in a direction along the handle of the wrench. In addition the Wright handle fits loosely on certain wrenches since one size handle is used for different size wrenches. If the wrench should slip the user may bruise their hand as the wrench slips free of the nut.

The Gandell U.S. Pat. No. 1,463,077 shows a handle that has an adjustable mount for different size spanner wrench handles. The Gandell extension handle, while providing a method to increase the leverage, does not firmly engage th wrench but relies on the pressure on the extension handle to hold the handle on the wrench.

The Morgan U.S. Pat. No. 1,643,027 shows an offset extension handle for a wrench that has a seat and a U shaped portion to hold the handle on the wrench. The Morgan extension handle loosely fits the jaw of the wrench into the seat and also relies on the pressure on the handle to hold the handle on the wrench.

The Wesson U.S. Pat. No. 1,746,452 shows what might aptly be called a "knuckle buster" since the provides a flat on the outside of the jaw to permit the user to place a second wrench end-to-end with a first wrench and then use the second wrench as a handle. The Wesson device while not requiring any extra tool for an extension handle is subject to one wrench slipping out of the jaws of the other wrench since there is nothing to laterally hold the two wrenches in an end-to-end relationship when the user applies pressure on the outer wrench.

Following the Wesson tool, Olson invented an end wrench set that has shoulders and offset jaws on the wrenches that form end-to-end engagement with each other to prevent the wrenches from slipping out of engagement with one another. The Olson invention is shown in U.S. Pat. No. 2,142,589 and requires that the two wrenches have mating sections and be assembled or separated by endwise sliding of the two wrenches into or out of engagement with each other. Olson stated his invention was to eliminate the problem of wrenches slipping out of alignment as the mechanics intergaged the jaws of the two end wrenches.

In 1949 Nesbitt obtained U.S. Pat. No. 2,490,739 on a slidable plate member having V shaped grooves to fit along the handle of the wrench with the slidable plate member having an opening to receive an L shaped handle that the user applied force to increase the torque on the wrench held in the slidable plate member.

In 1968 Fortunato obtained U.S. Pat. No. 3,376,768 on a linkage bar having a pair of stud-like projections on each end that could be connected between a pair of wrenches to enable a user to get the wrench into an inaccessible location. Fortunato recognized the problems that long lever bars or handles cannot always be used and that some means must be provided to apply more torque to wrenches that are located in inaccessible locations. In addition Fortunator located polygonate aperture in his linkage bar to permit one to also apply a torque bar to the linkage if additional force is required.

In 1974 Richards obtained U.S. Pat. No. 3,839,929 on a compound wrench that permitted the user to increase the leverage without substantially increasing the bulk of the wrench.

In 1978 Stoops obtained U.S. Pat. No. 4,104,935 for temporarily coupling an extension handle to a wrench to increase the leverage on the wrench. The Stoops tool used posts to engage the handle in a manner similar to that of Nesbitt. The Stoops tool also included a socket 12 for attachment to a breaker bar to permit the user to increase the torque on the wrench.

In 1986 White obtained U.S. Pat. No. 4,596,167 on a torque multiplier wrench set that permitted the user to stack identical wrenches end-to-end to increase the torque on the socket.

Throughout the evolution of the aforedescribed inventions it is apparent that the inventions required a separate special handle or that one fitted the wrenches in an end-to-end relationship. Both the Wesson and the Olson patents, who fitted wrenches in an end-to-end relationship, incorporated special flats onto the wrench to permit the extension of leverage arm on the wrench. The Wesson wrench included a special flat on the jaw of the wrench to permit end-to-end engagement of his wrenches. The Olson invention also used flats on his wrench but located the flats on the handle portion of his wrench.

The concept of socket drive systems and socket heads is well known in the art. Typically, a square drive socket wrench has a square peg that can be inserted into a mating recess in a cylindrical socket that has an opening for mating with a fastener. While cylindrical sockets are the most common there are also open end tools that have open jaws and a square hole to receive the square peg of the ratchet drive. Such tools are referred to as "crowfoot" tools. In addition, there are also special short handle tools that have an opening for engaging a ratchet drive but lack any handle that permits the user to use the wrench in a normal manner by applying hand torque to the wrench.

None of the prior art suggested or taught the art how to provide a wrench that the torque can be increased, that does not require searching for the proper handle, that will not slip, that can be positioned at various angles to the wrench to enable the user to get in locations that would be inaccessible to wrenches with end-to-end extensions and that does not require extra tools for attachment to the wrench.

SUMMARY OF THE INVENTION

Briefly, the present invention comprises a wrench having a socket opening in the web of the wrench to permit the user to quickly attach a rachet drive or breaker bar to the wrench to enable the user to increase the leverage on the wrench even if the wrench is located in an inaccessible location.

DESCRIPTION OF THE PREFERRED EMBODIMENT

Figure 1:
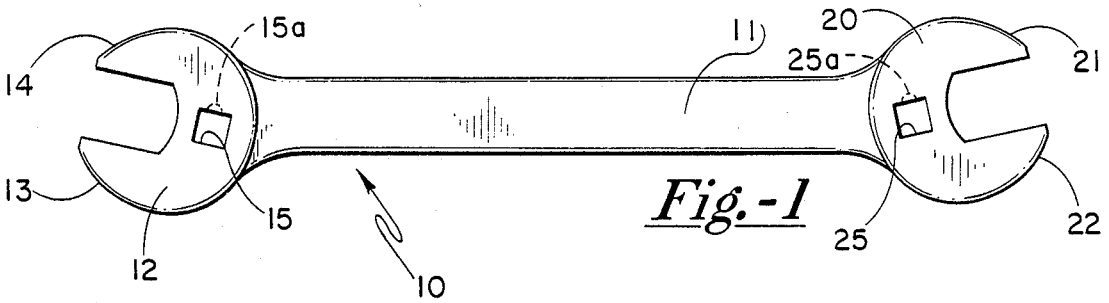
FIG. 1 is a front view of my invention.

Referring to FIG. 1 reference numeral 10 generally identifies my invention comprising an open end fixed jaw wrench having an enlarged and hardened head 12 on one end and a similar enlarged and hardened head 20 on the opposite end connected to each other by a handle 11 which has a sufficient length for a user to grasp the handle in the user's hand and apply torque to the nut. Such wrenches are useable and adequate in most situations, however, occasionally a user encounters a nut that the user is unable to loosen by applying hand torque to the handle of the wrench. It is in the situations that require greater-than-normal torque or situations that require the use working at an unusual position that the present invention benefits the user.

Head 12 comprises a top jaw 14 and a bottom jaw 13 which are formed in the enlarged and hardened head portion 12 of wrench 10 to engage a nut or lug. Similarly, head 20 contains a top jaw 21 and a bottom jaw 22 which are also formed in an enlarged and hardened head portion 20. The opening between the jaw in head 12 and the jaws in head 20 may be the same or may be slightly different to enable the user to use a single wrench on two different size nuts. The aforedescribed portions of wrench 10 are well known to those in the art.

Figure 2:
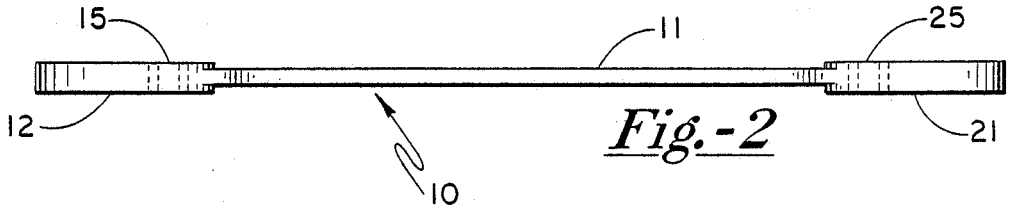
FIG. 2 is a top view of my invention.

My improvement to the existing wrenches comprises incorporating a socket opening in the web area of the wrench to permit use of the wrench with a socket drive. FIG. 1 shows my wrench with an opening 15 in the web area of wrench 10 and a second socket opening 25 in the web area located at the opposite end of wrench 10. Socket openings 15 and 25 are similar to the socket openings contained in sockets that receive conventional ratchet drive handles. Socket opening 15 is located in the enlarged and hardened head portion 12 and similarly, socket opening 25 is located in the enlarged and hardened head portion 20 to provide a socket opening that can receive a ratchet drive, breaker bar or the like. The location of the socket opening in the hardened web area of the wrench ensures that the drive of the socket will make firm, positive engagement of the wrench. In each of the socket openings I provide a recess for engaging the conventional retractable ball stop found in conventional ratchet drives. Reference numeral **15*a* identifies the outline of the spherical shaped recess located in head 12 and reference numeral 25a identifies a similar spherical shaped opening located in head 20. FIG. 2 illustrates the enlarged or wider width of the head portion of wrench to the connecting handle 11**.

Figure 3:
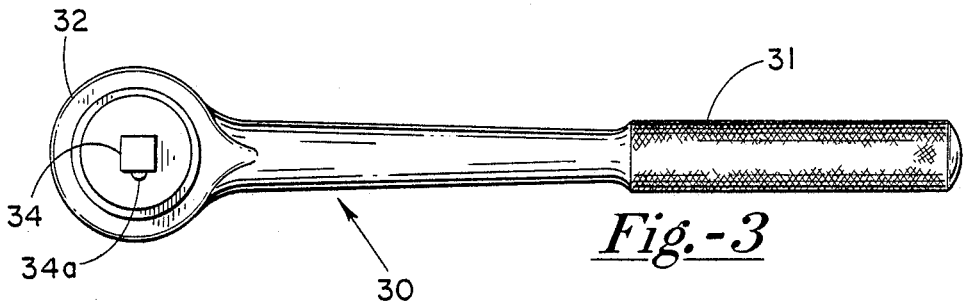
FIG. 3 is a back view of a conventional ratchet drive for use with a socket drive.

FIG. 3 shows a conventional commercially available ratchet drive 30 for connecting to a conventional drive socket Ratchet drive 30 includes a ratchet head 32 on one end and a handle 31 located on the opposite end. The ratchet drive and a breaker bar are conventional tools that virtually all mechanics possess and use frequently. The availability of ratchet drive with their square drive member 34 and retractable ball locks **34*a*** make it excellent for use with my invention.

Figure 4:
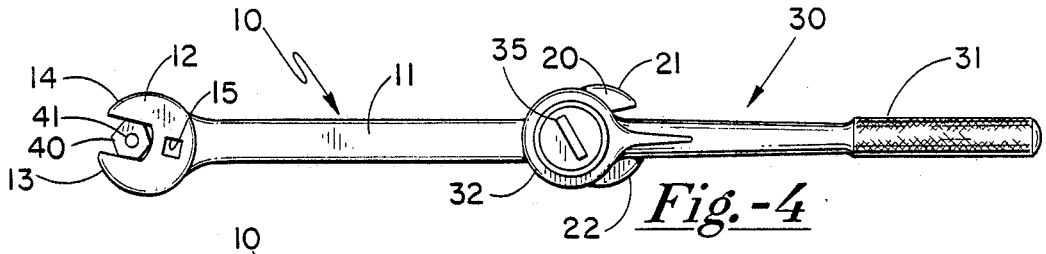
FIG. 4 shows my invention with a conventional ratchet drive connected to my invention.

FIG. 4 illustrates the use of a conventional ratchet drive 30 with my invention 10. One end of wrench 10 is located on the flats of nut 40 which is fastened to bolt 41. In order to permit the user to increase the leverage on wrench 10, I have engaged drive peg 34 of ratchet drive 30 with the ratchet opening 25 located in head 20 of wrench 10. Simply by pressing on handle 31 I can increase the leverage on nut 40. Also, since drive peg 34 and ball lock **34*a* engage the drive opening 25, I can securely hold wrench 10 with ratchet drive 30**.

Figure 5:
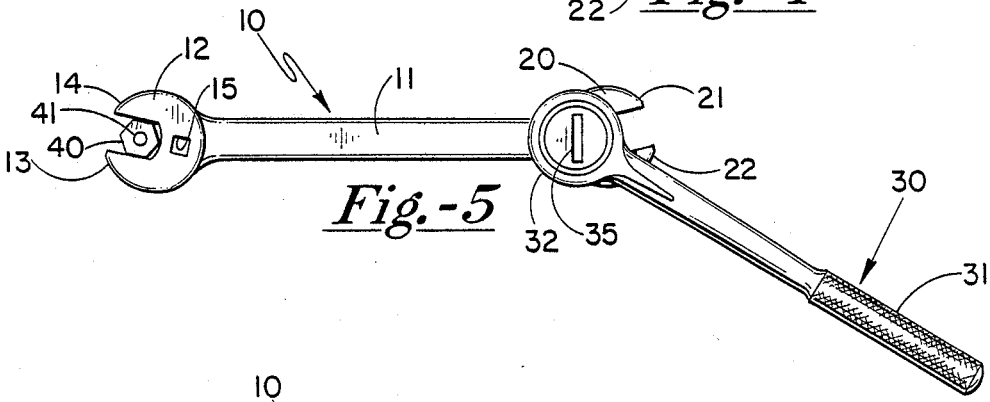
FIG. 5 shows my invention with the conventional ratchet drive located at an offset angle from the handle of my invention.

FIG. 5 illustrates how ratchet drive 30 can be mounted to wrench 10 at an angle to permit the user to locate the wrench and ratchet in location that are inaccessible to conventional straight extension handles.

Figure 6:
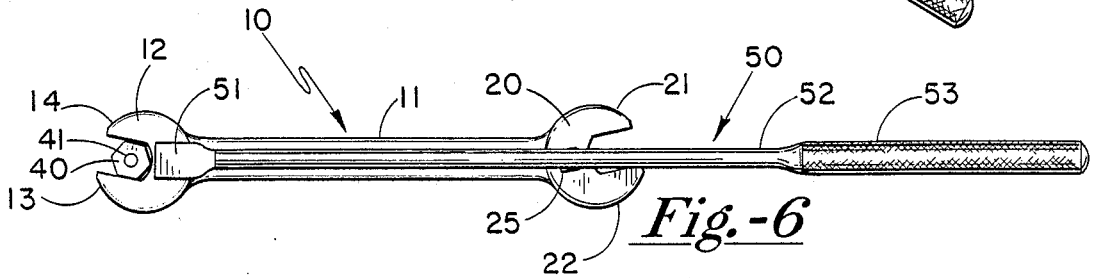
FIG. 6 shows a breaker bar attached to my invention.

FIG. 6 illustrates my invention 10 that is connected to a breaker bar 50 instead of a ratchet drive 30. Breaker bar 50 is similar to ratchet drive 30 and contains a drive peg 51 on one end for mating with a drive opening in wrench 10. A handle 52 connects one end of breaker bar to a handle grip 53 located on the opposite end of breaker bar 50. To illustrate the versatility of my invention I have inserted the drive peg of breaker bar in the head 12 which is adjacent the nut rather than in head 20 which is on the opposite end of wrench 10. In this position the user can apply force to handle 53 and if the user needs to steady the wrench on the nut, the user can place the other hand on wrench 10 and handle 52 of the breaker bar 52. Of course if greater leverage is needed, the user can place drive peg 51 in the end of wrench 10 that does not engage nut 40. Thus it will be envisioned that I have provided an extension handle for a wrench that does not require a special handle to engage the wrench but relies on the existing drive peg in a ratchet drive mechanism to engage my specially located drive openings in wrench 10. While I have shown the location of my socket opening in the opposite head of the open jaw wrenches, my invention is also suitable for use with other types of wrenches such as crescent, box, bonnie, pipe or the like which have handles on the wrench that are sufficiently long for the user to grasp in his or her hand as the user uses the wrench to tighten or fasten a nut.

While the invention has been described as having a hardened head or web it should be understood that the hardness of the head for use in particular applications will depend on the size of the opening in the jaws of the wrench. That is, for smaller fasteners that cannot withstand high torque the jaws may need very little hardening but with larger fasteners that have to withstand higher torque the jaws may require greater hardness. The relative hardness requirements of the present invention can readily be determined from the existing state of the art. In certain applications the metals used to make the tool may have sufficient hardness so that the area on the tools that receive the highest torque need not be reinforced through hardening. This would be particularly true with smaller fasteners that cannot withstand higher torques without shearing.

I claim:

1. A wrench for use in a conventional manner of tightening or loosening fasteners and for use with a socket drive mechanism to provide additional leverage to permit the user to provide greater torque than the user can generate through application of hand force on the wrench comprising:

a wrench having a first head, a second head and a handle, said handle having a first end and a second end, said first end of said handle connected to said first head and said second end of said handle connected to said second head, said first head, said second head and said handle lying substantially in a plane, said first head including a hardened area with a first pair of jaws located in said hardened area of said first head, said first pair of jaws operable for engaging a fastener to permit a user to apply a torque to the fastener by applying a force to said handle, said second head including a hardened area with a second pair of jaws located in said hardened area of said second head, said second pair of jaws operable for engaging a fastener to permit a user to apply a torque to a fastener by applying a force on said handle, said first head including a first socket drive opening to receive a socket drive mechanism to permit a sure to increase the leverage on said wrench and to position a socket drive mechanism in a suitable position, said first socket drive opening located in said hardened area of said first head, said first socket drive opening located flush with said first head so as not to interfere with use of said wrench without a socket drive mechanism, said second head including a second socket drive opening to receive a socket drive mechanism to permit a user to increase the leverage on said wrench and to position a socket drive mechanism in a suitable position, said second socket drive opening in said second head located in said hardened area of said second head, said second socket drive opening in said second head located flush with said second head so as not to interfere with use of said wrench without a socket drive mechanism so that either said first pair of jaws or said second pair of jaws of said wrench can be used in a conventional manner to loosen or secure a fastener or can be used with a socket drive mechanism to provide a longer lever arm to enable the user to increase the torque on a fastener without the user having to increase the hand force.

2. The wrench of claim 1 wherein said first pair of jaws in said wrench have open jaws and said second pair of jaws in said wrench have open jaws for engaging a nut.

3. The wrench of claim 1 wherein said socket drive openings are square and having sides extending through said wrench with the sides of the socket drive openings located parallel to the jaws of said wrench.

* * * * *